US012084732B2

(12) United States Patent
Radon et al.

(10) Patent No.: US 12,084,732 B2
(45) Date of Patent: Sep. 10, 2024

(54) HYPEREUTECTIC WHITE IRON ALLOY COMPRISING CHROMIUM, BORON AND NITROGEN AND CRYOGENICALLY HARDENED ARTICLES MADE THEREFROM

(71) Applicant: Townley Foundry & Machine Co., Inc., Belleview, FL (US)

(72) Inventors: Roman Radon, Belleview, FL (US); Jerzy Ferdynandt Piotrowski, Summerfield, FL (US)

( * ) Notice: Subject to any disclaimer, the term of this patent is extended or adjusted under 35 U.S.C. 154(b) by 0 days.

(21) Appl. No.: 17/656,946

(22) Filed: Mar. 29, 2022

(65) Prior Publication Data

US 2023/0313331 A1 Oct. 5, 2023

(51) Int. Cl.
*C21D 5/04* (2006.01)
*C22C 37/08* (2006.01)
*C22C 37/10* (2006.01)

(52) U.S. Cl.
CPC ..... *C21D 5/04* (2013.01); *C22C 37/08* (2013.01); *C22C 37/10* (2013.01)

(58) Field of Classification Search
CPC ..... C22C 37/00–10
See application file for complete search history.

(56) References Cited

U.S. PATENT DOCUMENTS 2,353,688 A 7/1944 Burgess
3,834,950 A 9/1974 Feltz
4,547,221 A * 10/1985 Norman ..... C22C 37/08 420/12
4,765,836 A * 8/1988 Hauser ..... C22C 33/0285 75/238
5,183,518 A * 2/1993 Radon ..... C22C 37/08 148/612
5,252,149 A 10/1993 Dolman
5,514,065 A 5/1996 Noda et al.
5,803,152 A 9/1998 Dolman et al.
5,936,169 A 8/1999 Pinnow et al.
6,761,777 B1 7/2004 Radon
8,083,869 B2 12/2011 Takayama et al.
(Continued)

FOREIGN PATENT DOCUMENTS

CN 101497966 A 8/2009
CN 102251185 A 11/2011
(Continued)

OTHER PUBLICATIONS

"Glossary of Metallurgical and Metalworking Terms", Metals Handbook, ASM International, 2002, terms: hypereutectic alloy, white iron.

(Continued)

*Primary Examiner* — Alexandra M Moore
*Assistant Examiner* — Austin Pollock
(74) *Attorney, Agent, or Firm* — Abel Schillinger, LLP

(57) ABSTRACT

A hypereutectic chromium white iron alloy which comprises, in weight percent based on the total weight of the alloy, from 1.5 to 2.85 carbon, from 0.01 to 1.2 nitrogen, from 0.1 to 1.4 boron, from 3 to 34 chromium, from 0.1 to 7.5 Ni, and from 0.1 to 4 Si. The alloy may optionally comprise one or more additional elements, i.e., manganese, cobalt, copper, molybdenum, tungsten, vanadium, niobium, titanium, zirconium, magnesium and/or calcium, one or more rare earth elements, and one or more of tantalum, hafnium, aluminum. The remainder of the alloy is constituted by iron and unavoidable (incidential) impurities. Articles cast from the alloy, especially cryogenically hardened articles, are also disclosed.

19 Claims, 2 Drawing Sheets

(56) References Cited

U.S. PATENT DOCUMENTS

| | | | | |
|---|---|---|---|---|
| 8,187,529 | B2 | 5/2012 | Powell | |
| 8,479,700 | B2 * | 7/2013 | Qiao | C22C 1/02 251/359 |
| 8,940,110 | B2 * | 1/2015 | Qiao | C22C 33/0214 123/188.8 |
| 9,284,631 | B2 | 3/2016 | Radon et al. | |
| 9,458,743 | B2 * | 10/2016 | Qiao | F01L 3/04 |
| 9,580,777 | B1 | 2/2017 | Radon et al. | |
| 2012/0160363 | A1 | 6/2012 | Jin et al. | |
| 2013/0084462 | A1 | 4/2013 | Theisen et al. | |
| 2015/0284829 | A1 * | 10/2015 | Cheney | C22C 37/06 420/12 |
| 2015/0329944 | A1 | 11/2015 | Radon et al. | |

FOREIGN PATENT DOCUMENTS

| | | | | |
|---|---|---|---|---|
| CN | 104532151 | A | * 4/2015 | |
| CN | 105734398 | A | * 7/2016 | |
| CN | 106244903 | A | * 12/2016 | |
| CN | 106319336 | A | * 1/2017 | C21D 1/18 |
| CN | 113481425 | A | * 10/2021 | |
| EP | 0178894 | A | * 4/1986 | |
| GB | 2153846 | A | 8/1985 | |
| JP | 2000345280 | A | * 12/2000 | |
| KR | 2009045252 | A | * 5/2009 | B23K 35/0266 |
| SU | 831849 | B | * 5/1981 | |
| SU | 1151585 | A | * 4/1985 | |
| SU | 1765236 | A1 | * 9/1992 | |
| WO | 8404760 | A1 | 12/1984 | |
| WO | 2017139083 | A | 8/2017 | |

OTHER PUBLICATIONS

Heat Treating of High-Alloy White Cast Irons, Heat Treating of Irons and Steels, vol. 4D, ASM Handbook, ASM International, 2014, pp. 527-535 (print), 27pages (consolidated) online.

* cited by examiner

HYPEREUTECTIC WHITE IRON ALLOY COMPRISING CHROMIUM, BORON AND NITROGEN AND CRYOGENICALLY HARDENED ARTICLES MADE THEREFROM

BACKGROUND OF THE INVENTION

1. Field of the Invention

The present invention relates to a low-carbon hypereutectic white iron alloy that comprises chromium, boron and nitrogen, as well as to articles such as pump components made therefrom (e.g., by sand casting) which can be hardened cryogenically.

2. Discussion of Background Information

High chromium white iron alloys find use as abrasion resistant materials for the manufacture of, for example, casings of industrial pumps, in particular pumps which come into contact with abrasive slurries of minerals. This alloy material has exceptional wear resistance and good toughness with its hypoeutectic and eutectic compositions. For example, high chromium white iron in accordance with the ASTM A532 Class III Type A contains from 23% to 30 wt. % of chromium and about 2.0% to 3.3 wt. % of carbon. However, in severely abrasive applications the wear resistance of these high chromium white iron alloys is not satisfactory due to a lack of a sufficient "Carbide Volume Fraction" (CVF). It is well known that increasing the content of both Cr and C can considerably improve the wear resistance of high chromium white iron alloys under severely abrasive conditions. For example, hypereutectic Fe—Cr—C alloys for hardfacing typically contain 4.5% C and 24% Cr. The amount of carbides and in particular, the CVF can be estimated from the following experimentally developed equation: CVF=12.33×% C+0.55×(% Cr+% M)−15.2% (M representing one or more carbide forming elements in addition to chromium, if any).

Hardfacing has the benefit of making an article wear resistant by cladding, i.e., by depositing a layer of an alloy of wear resistant composition thereon. However, hardfacing methods have disadvantages, including a limited thickness of the cladding, distortion of the article to be cladded, and high costs of labor, cladding material and equipment. Moreover, the cladding usually is susceptible to developing defects such as spalling and cracking due to thermal stresses and contraction, and it shows constraints with respect to thermal hardening.

Further, making (slurry) pump components such as pump casings by common foundry methods from hypereutectic high chromium white iron alloys is virtually impossible due to high scrap and rejection rates. Pump casings are large and heavy and are not uniform in thickness. For example, cross-sections in some areas of a pump casing may be up to 10 inch and the wall thickness in at least some parts thereof may be 1 inch or even higher. In view thereof, it is virtually impossible for a casting to cool uniformly in a sand mold, which results in stress induced cracking during cooling.

In particular, during solidification in a sand mold, hypereutectic high chromium cast iron forms a primary phase by nucleation and growth processes. Large primary chromium carbides, up to several hundreds microns in length, crystallize in the thick sections of the casting where the cooling is slower than in the remainder of the casting. These large primary carbides lower the fracture toughness of a casting, wherefore the casting usually cracks during the manufacturing process or later during application in the work field.

For the foregoing reasons, most of the existing hypereutectic high chromium white cast iron alloys are not suitable for the sand casting of large parts and there have been various attempts to address this problem.

One solution to the above problem is disclosed in WO 2017/139083, the entire disclosure of which is incorporated herein. WO 2017/139083 discloses a hypereutectic chromium white iron alloy which comprises, in weight percent based on the total weight of the alloy, from 3 to 6 carbon, from 0.01 to 1.2 nitrogen, from 0.1 to 4 boron, from 3 to 48 chromium, from 0.1 to 7.5 Ni, and from 0.1 to 4 Si. The alloy may optionally comprise one or more additional elements, especially manganese (up to 8), cobalt (up to 5), copper (up to 5), molybdenum (up to 5), tungsten (up to 6), vanadium (up to 12), niobium (up to 6), titanium (up to 5), zirconium (up to 2), magnesium and/or calcium (total up to 0.2), one or more rare earth elements, i.e., one or more of Sc, Y, La, Ce, Pr, Nd, Pm, Sm, Eu, Gd, Tb, Dy, Ho, Er, Tm, Yb, Lu (total up to 3), and one or more of tantalum, hafnium, aluminum, (total up to 3). The remainder of the alloy is made up by iron and unavoidable (incidential) impurities.

While the alloys disclosed in WO 2017/139083 overcome some of the problems mentioned above, these alloys still leave room for improvement, especially with respect to the formation of microcracks in articles cast therefrom and hardened cryogenically. In particular, it would be advantageous to be able to harden articles cast from these alloys by cryogenic hardening instead of by the much more energy intensive (and thus, more expensive) conventional thermal hardening, usually at temperatures of from 1000° C. to 1100° C., without compromising on the properties of the hardened articles. When hardened cryogenically, articles cast from the alloys of WO 2017/139083 tend to be hard but also relatively brittle. This brittleness is believed to be caused by precipitated secondary carbides. Avoiding or at least significantly reducing the formation of secondary carbides would thus, make the metal matrix obtained by cryogenic hardening tougher and also more abrasion-resistant, due to a much harder martensite matrix. It has unexpectedly been found that the formation of secondary carbides in articles which are cast from some of the alloys disclosed in WO 2017/139083 and subsequently are cryogenically hardened can be accomplished by reducing the concentration of carbon below the concentration present in the alloys of WO 2017/139083.

SUMMARY OF THE INVENTION

The present invention provides a hypereutectic chromium white iron alloy which comprises, in weight percent based on the total weight of the alloy, from 1.5 to 2.85 carbon, from 0.01 to 1.2 nitrogen, from 0.1 to 1.4 boron, from 3 to 34 chromium, from 0.1 to 7.5 Ni, and from 0.1 to 4 Si. The alloy may optionally comprise one or more additional elements, especially manganese (up to 8), cobalt (up to 5), copper (up to 5), molybdenum (up to 5), tungsten (up to 6), vanadium (up to 12), niobium (up to 6), titanium (up to 5), zirconium (up to 2), magnesium and/or calcium (total up to 0.2), one or more rare earth elements, i.e., one or more of Sc, Y, La, Ce, Pr, Nd, Pm, Sm, Eu, Gd, Tb, Dy, Ho, Er, Tm, Yb, Lu (total up to 3), and one or more of tantalum, hafnium, aluminum, (total up to 3). The remainder of the alloy usually is constituted by iron and unavoidable (incidential) impurities.

In one aspect, the alloy of the invention may comprise from 1.8% to 2.75% C, e.g., from 1.9% to 2.72% C, from 2.0% to 2.65% C, or from 2.1% to 2.60% C.

In another aspect, the alloy of the invention may comprise at least 0.3% B (e.g., at least 0.7% B) and/or from 0.02% to 0.5% N and/or from 6% to 28% Cr and/or from 0.3% to 5% Ni and/or from 0.3% to 3% Si.

In yet another aspect, the alloy of the invention may comprise:

| | |
|---|---|
| C | from 2.15 to 2.72 |
| B | from 0.4 to 1.4 |
| N | from 0.01 to 0.4 |
| Cr | from 8 to 28 |
| Ni | from 0.3 to 5 |
| Si | from 0.4 to 3 |
| Mn | from 0.5 to 1.4 |
| Co | from 0 to 5 |
| Cu | from 0 to 0.9 |
| Mo | from 0 to 3 |
| W | from 0 to 6 |
| V | from 0 to 2 |
| Nb | from 0 to 2 |
| Ti | from 0 to 5 |
| Zr | from 0 to 2 |
| (Mg + Ca) | from 0 to 0.2 |
| one or more rare earth elements | from 0 to 3 |
| one or more of Ta, Hf, Al | from 0 to 3, |
| remainder Fe and incidential impurities. | |

In another aspect, the alloy of the invention may have one of the following compositions 1 to 4:

| Composition | 1 | 2 | 3 | 4 |
|---|---|---|---|---|
| C | 2.2-2.7 | 1.6-2.0 | 1.9-2.6 | 2.0-2.7 |
| Si | 0.5-0.7 | 0.4-0.6 | 2.0-2.3 | 0.4-1.0 |
| Mn | 0.6-1.3 | 0.6-1.0 | 0.5-1.2 | 0.5-1.0 |
| Cr | 26.0-27.0 | 25-26 | 8-9 | 16-17 |
| Mo | 0.5-1.0 | 0.0-1.0 | 0.0-0.6 | 2.0-2.8 |
| Ni | 0.3-0.5 | 0.5-1.3 | 4-4.5 | 0.5-0.8 |
| Cu | 0.5-0.7 | 0.0-0.3 | 0.2-0.6 | 0.2-0.8 |
| V | 0.0-1.4 | 0.0-1.0 | 1.0-1.5 | 0.0-1.2 |
| Nb | 0.0-1.4 | 0.0-1.0 | 0.8-1.0 | 0.0-1.2 |
| B | 0.4-1.1 | 0.4-1.0 | 0.7-1.2 | 0.4-1.0 |
| N | 0.05-0.4 | 0.03-0.2 | 0.01-0.025 | 0.02-0.08 |

In another aspect of the alloy of the invention, an article cast from the alloy may be hardened cryogenically. For example, it may be possible to increase the metal matrix microhardness (represented by the Vickers hardness (HV)) of an article cast from the alloy by cryogenic hardening by at least 15%, e.g., by at least 16%, by at least 17%, by at least 18%, by at least 19%, or by at least 20%.

In another aspect, it may be possible to increase the Brinell hardness (HB) of an article sand cast from the alloy of the invention by cryogenic hardening by at least 10%, e.g., by at least 11%, by at least 12%, by at least 13%, by at least 14%, or by at least 15%.

The present invention also provides an article which is cast (e.g., sand cast or chill cast in a copper mold) from the alloy of the invention as set forth above (including the various aspects thereof). In some embodiments, the article of the present invention may be a component (e.g., a casing) of a pump (e.g., of a slurry pump).

In one aspect of the article, the Brinell hardness (HB) of the sand cast article (as cast) may be at least 550, e.g., at least 580, at least 600, at least 610, at least 620, at least 630, at least 640, or at least 650, as measured with a 10 mm tungsten ball and a load of 3000 kgf.

In another aspect of the article, the sand cast article may have been hardened by cryogenic hardening. After cryogenic hardening, the Brinell hardness (HB) of the article may be, for example, at least 650, e.g., at least 680, at least 700, at least 720, at least 740, at least 760, or at least 780.

The present invention also provides a method of hardening an article cast (e.g., sand cast or chill cast in a copper mold) from the alloy of the invention as set forth above (including the various aspects thereof). The method comprises subjecting the article to cryogenic hardening.

In one aspect of the method, the cryogenic hardening may comprise cooling the article (preferably with liquid nitrogen, liquid air or liquid argon, although dry ice may also be useful for this purpose) at a cooling rate of from about 20° C. to about 40° C. per hour, e.g., from about 25° C. to about 35° C. per hour, until the temperature of the article has reached from about −75° C. to about −90° C., e.g., from about −80° C. to about −85° C., and keeping the article at that temperature for about 15 minutes to about 35 minutes, e.g., from about 20 minutes to about 30 minutes, for every cm of thickness of the article.

BRIEF DESCRIPTION OF THE DRAWINGS

The present invention is further described in the detailed description which follows, in reference to the drawings wherein.

DETAILED DESCRIPTION OF EMBODIMENTS OF THE PRESENT INVENTION

Figure 1:
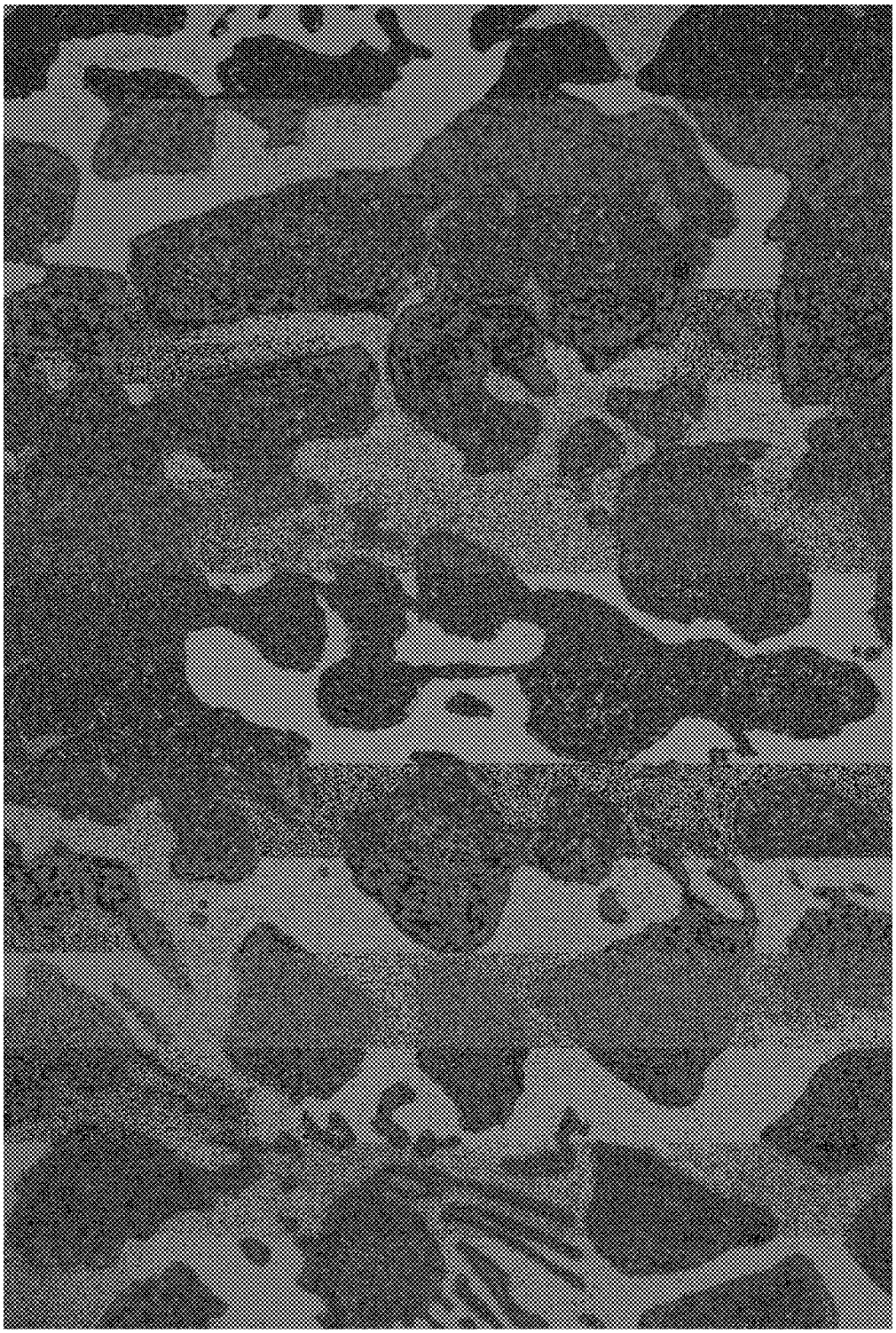
FIG. 1 is a photograph which shows the microstructure of a sample made, from Alloy 3 set forth below in Example 1 after hardening by heating.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

As used herein, the singular forms "a," "an," and "the" include the plural reference unless the context clearly dictates otherwise. For example, reference to "an alloy" would also mean that combinations of two or more alloys can be present unless specifically excluded.

Except where otherwise indicated, all numbers expressing quantities of ingredients, reaction conditions, etc. used in the instant specification and appended claims are to be understood as being modified in all instances by the term "about." Accordingly, unless indicated to the contrary, the numerical parameters set forth in the specification and claims are approximations that may vary depending upon the desired properties sought to be obtained by the present invention. At the very least, each numerical parameter should be construed in light of the number of significant digits and ordinary rounding conventions.

Additionally, the disclosure of numerical ranges within this specification is considered to be a disclosure of all numerical values and ranges within that range. For example, if a range is from 1 to 50, it is deemed to include, for example, 1, 7, 34, 46.1, 23.7, or any other value or range within the range.

The various embodiments disclosed herein can be used separately and in various combinations unless specifically stated to the contrary.

In addition to iron, the alloy of the invention comprises six required components, i.e., C, B, N, Cr, Si and Ni. The weight percentage of C in the alloy of the invention is at least 1.5%, e.g., at least 1.6%, at least 1.7%, at least 1.8%, at least 1.9%, at least 2.0%, at least 2.1%, at least 2.15%, at least 2.16%, at least 2.17%, or at least 2.18% but not higher than 2.85%, e.g., not higher than 2.8%, not higher than 2.75%, not higher than 2.72%, not higher than 2.68%, not higher than 2.65%, not higher than 2.63%, not higher than 2.60%, not higher than 2.57%, not higher than 2.55%, not higher than 2.53%, or not higher than 2.50%.

The weight percentage of Cr in the alloy of the invention is at least 3%, but not higher than 34%. The weight percentage of Cr usually is at least 4%, at least 5%, at least 6%, at least 7%, at least 7.5%, or at least 8%, but not higher than 30%, e.g., not higher than 28%, or not higher than 27%.

The weight percentage of N in the alloy of the invention is at least 0.01%, e.g., at least 0.02%, at least 0.03%, at least 0.04%, at least 0.05%, at least 0.06%, at least 0.07%, at least 0.08%, at least 0.09%, at least 0.1%, at least 0.15%, at least 0.2%, at least 0.25%, or at least 0.3%, but not higher than 1.2%, e.g., not higher than 1.1%, not higher than 1.0%, not higher than 0.9%, not higher than 0.8%, not higher than 0.7%, not higher than 0.6%, not higher than 0.5%, or not higher than 0.45%.

The weight percentage of B in the alloy of the invention is at least 0.1%, e.g., at least 0.15%, at least 0.2%, at least 0.25%, at least 0.3%, at least 0.35%, at least 0.4%, at least 0.45%, at least 0.5%, at least 0.6%, at least 0.7%, at least 0.8%, at least 0.9%, or at least 1% but not higher than 1.4%, e.g., not higher than 1.35%, not higher than 1.3%, not higher than 1.25%, or not higher than 1.2%.

The weight percentage of Ni in the alloy of the invention is at least 0.1%, e.g., at least 0.2%, at least 0.3%, at least 0.4%, at least 0.45%, or at least 0.5%, but not higher than 7.5%, e.g., not higher than 7%, not higher than 6.5%, not higher than 6%, not higher than 5.5%, not higher than 5%, or not higher than 4.5%.

The weight percentage of Si in the alloy of the invention is at least 0.1%, e.g., at least 0.15%, at least 0.2%, at least 0.25%, at least 0.3%, at least 0.35%, or at least 0.4% but not higher than 4%, e.g., not higher than 3.8%, not higher than 3.6%, not higher than 3.4%, not higher than 3.2%, not higher than 3%, not higher than 2.8%, not higher than 2.6%, or not higher than 2.4%.

The alloy of the invention usually comprises one or more additional elements, i.e., in addition to Fe, Cr, C, B, N, Ni and Si. For example, often the alloy will also comprise at least one or more (and frequently all or at least two, three or four) of V, Mn, Mo, Nb, Ti and Al. However, other elements such as one or more (e.g., two, three or four) of W, Co, Cu, Mg, Ca, Ta, Zr, Hf, rare earth elements may (and often will) be present as well.

If employed, the weight percentage of V in the alloy of the invention usually is at least 0.5%, e.g., at least 0.6%, at least 0.7%, at least 0.8%, or at least 0.9%, but usually not more than 4%, e.g., not more than 3.5%, not more than 3%, not more than 2.5%, not more than 2%, or not more than 1.5%.

If employed, Mn is usually present in the alloy of the invention in a weight percentage of at least 0.2%, e.g., at least 0.3%, at least 0.4%, at least 0.5%, at least 0.6%, or at least 0.65%, but usually not higher than 8%, e.g., not higher than 6%, not higher than 4%, not higher than 3%, not higher than 2%, or not higher than 1.5%.

If employed, Co is usually present in the alloy of the invention in a weight percentage of at least 0.1%, e.g., at least 0.15%, at least 0.2%, at least 0.25%, or at least 0.3%, but usually not higher than 4%, e.g., not higher than 3%, not higher than 2%, not higher than 1.5%, not higher than 1%, or not higher than 0.5%.

If employed, Cu is usually present in the alloy of the invention in a weight percentage of at least 0.1%, e.g., at least 0.2%, at least 0.3%, at least 0.4%, at least 0.45%, or at least 0.5%, but usually not higher than 5%, e.g., not higher than 4%, not higher than 3%, not higher than 2%, not higher than 1.5%, or not higher than 1.2%.

If employed, Mo and/or W are usually present in the alloy of the invention in a combined weight percentage of at least 0.3%, e.g., at least 0.5%, at least 0.6%, or at least 0.7%, but usually not higher than 5%, e.g., not higher than 4%, not higher than 3%, not higher than 2.5%, or not higher than 2.2%. If only one of Mo and W is to be present, preference is usually given to Mo, which in this case is usually present in weight percentages not higher than 3.5%, e.g., not higher than 3%, not higher than 2.5%, or not higher than 2.2%.

If employed, Nb is usually present in the alloy of the invention in a weight percentage of at least 0.1%, e.g., at least 0.2%, at least 0.3%, at least 0.4%, at least 0.5%, or at least 0.55%, but usually not higher than 5%, e.g., not higher than 4%, not higher than 3%, not higher than 2%, or not higher than 1.5%.

If employed, Ti is usually present in the alloy of the invention in a weight percentage of at least 0.1%, e.g., at least 0.2%, at least 0.3%, at least 0.4%, or at least 0.5%, but usually not higher than 5%, e.g., not higher than 4%, not higher than 3%, not higher than 2%, or not higher than 1%.

If employed, Zr is usually present in the alloy of the invention in a weight percentage of at least 0.05%, e.g., at least 0.1%, at least 0.15%, at least 0.2%, or at least 0.25%, but usually not higher than 2%, e.g., not higher than 1.8%, not higher than 1.6%, not higher than 1.3%, or not higher than 1%.

If employed, Al is usually present in the alloy of the invention in a weight percentage of at least 0.05%, e.g., at least 0.1%, at least 0.15%, at least 0.17%, at least 0.18%, at least 0.19%, at least 0.2%, at least 0.3%, or at least 0.4% but usually not higher than 2%, e.g., not higher than 1.5%, not higher than 1%, not higher than 0.9%, or not higher than 0.8%.

If employed at all, Mg and/or Ca are usually present in the alloy of the invention in a combined weight percentage of at least 0.01%, e.g., at least 0.02%, at least 0.03%, or at least 0.04% but usually not higher than 0.2%, e.g., not higher than 0.18%, not higher than 0.15%, or not higher than 0.12%. Each of Mg and Ca may be present in an individual weight percentage of at least 0.02% and not higher than 0.08%.

If employed, one or more rare earth elements are usually present in the alloy of the invention in a combined weight percentage of at least 0.05%, e.g., at least 0.08%, at least 0.1%, or at least 0.15%, but usually not higher than 2%, e.g., not higher than 1%, not higher than 0.9%, or not higher than 0.8%.

If employed, Ta, Zr, Hf, and Al are usually present in the alloy of the invention in a combined weight percentage of at least 0.01%, e.g., at least 0.05%, at least 0.08%, or at least 0.1%, but usually not higher than 3%, e.g., not higher than 2.5%, not higher than 2%, or not higher than 1.5%.

Among the unavoidable impurities which are usually present in the alloy of the invention, sulfur and phosphorus may be mentioned. Their concentrations are preferably not higher than 0.2%, e.g., not higher than 0.1%, or not higher than 0.06% by weight each.

The alloy of the invention is particularly suitable for the production of parts which must have a high wear (abrasion) resistance and are suitably produced by a process such as sand casting and chill casting. Non-limiting examples of such parts include slurry pump components, such as casings, impellers, suction liners, pipes, nozzles, agitators, valve blades. Other components which may suitably be made, at least in part, from the alloy of the present invention include, for example, shell liners and lifter bars in ball mills and autogenous grinding mills, and components of coal pulverizers.

Any conventional casting technology may be used to produce the alloy of the invention. For example, the alloy may be cast into sand molds. Alternatively, the alloy may be subjected to chill casting, for example, by pouring the alloy into a copper mold. This often affords a hardness which is significantly higher (e.g., by at least 20, and in some cases at least 50 Brinell units) than the hardness obtained by casting into a sand mold. If a hardening treatment is to be carried out, the preferred hardening method for the alloy of the invention is by cryogenic treatment: cooling to a temperature of, for example, about −100° F. to about −300° F., and maintaining at this temperature for a time of, for example, one hour per one inch of casting wall thickness. The cryogenic hardening process may be performed with equipment and machinery that is conventional in the thermal cycling treatment field. First, the articles-under-treatment are placed in a treatment chamber which is connected to a supply of cryogenic fluid, such as liquid nitrogen or a similar low temperature fluid. Exposure of the chamber to the influence of the cryogenic fluid lowers the temperature until the desired level of hardness is reached.

To sum up, the present invention provides:

1. A hypereutectic white iron alloy, wherein the alloy comprises, in weight percent based on a total weight of the alloy:

| | |
|---|---|
| C | from 1.5 to 2.85 |
| B | from 0.1 to 1.4 |
| N | from 0.01 to 1.2 |
| Cr | from 3 to 34 |
| Ni | from 0.1 to 7.5 |
| Si | from 0.1 to 4 |
| Mn | from 0 to 8 |
| Co | from 0 to 5 |
| Cu | from 0 to 5 |
| Mo | from 0 to 5 |
| W | from 0 to 6 |
| V | from 0 to 12 |
| Nb | from 0 to 6 |
| Ti | from 0 to 5 |
| Zr | from 0 to 2 |
| (Mg + Ca) | from 0 to 0.2 |
| one or more rare earth elements | from 0 to 3 |
| one or more of Ta, Hf, Al | from 0 to 3, |
| remainder Fe and incidential impurities. | |

2. The alloy of item 1, wherein the alloy comprises from 1.8% to 2.75% C.
3. The alloy of item 1, wherein the alloy comprises from 1.9% to 2.72% C.
4. The alloy of item 1, wherein the alloy comprises from 2.0% to 2.65% C.
5. The alloy of item 1, wherein the alloy comprises from 2.1% to 2.60% C.
6. The alloy of any one of items 1 to 5, wherein the alloy comprises at least 0.3% B (e.g., at least 0.7% B).
7. The alloy of any one of items 1 to 6, wherein the alloy comprises from 0.02% to 0.5% N.
8. The alloy of any one of items 1 to 7, wherein the alloy comprises from 6% to 28% Cr.
9. The alloy of any one of items 1 to 8, wherein the alloy comprises from 0.3% to 5% Ni.
10. The alloy of any one of items 1 to 9, wherein the alloy comprises from 0.3% to 3% Si.
11. The alloy of any one of items 1 to 10, wherein the alloy comprises:

| | |
|---|---|
| C | from 2.15 to 2.72 |
| B | from 0.4 to 1.4 |
| N | from 0.01 to 0.4 |
| Cr | from 8 to 28 |
| Ni | from 0.3 to 5 |
| Si | from 0.4 to 3 |
| Mn | from 0.5 to 1.4 |
| Co | from 0 to 5 |
| Cu | from 0 to 0.9 |
| Mo | from 0 to 3 |
| W | from 0 to 6 |
| V | from 0 to 2 |
| Nb | from 0 to 2 |
| Ti | from 0 to 5 |
| Zr | from 0 to 2 |
| (Mg + Ca) | from 0 to 0.2 |
| one or more rare earth elements | from 0 to 3 |
| one or more of Ta, Hf, Al | from 0 to 3, |
| remainder Fe and incidential impurities. | |

12. The alloy of any one of items 1 to 11, wherein the alloy has one of the following compositions 1 to 4:

| Composition | 1 | 2 | 3 | 4 |
|---|---|---|---|---|
| C | 2.2-2.7 | 1.6-2.0 | 1.9-2.6 | 2.0-2.7 |
| Si | 0.5-0.7 | 0.4-0.6 | 2.0-2.3 | 0.4-1.0 |
| Mn | 0.6-1.3 | 0.6-1.0 | 0.5-1.2 | 0.5-1.0 |
| Cr | 26.0-27.0 | 25-26 | 8-9 | 16-17 |
| Mo | 0.5-1.0 | 0.0-1.0 | 0.0-0.6 | 2.0-2.8 |
| Ni | 0.3-0.5 | 0.5-1.3 | 4-4.5 | 0.5-0.8 |
| Cu | 0.5-0.7 | 0.0-0.3 | 0.2-0.6 | 0.2-0.8 |
| V | 0.0-1.4 | 0.0-1.0 | 1.0-1.5 | 0.0-1.2 |
| Nb | 0.0-1.4 | 0.0-1.0 | 0.8-1.0 | 0.0-1.2 |
| B | 0.4-1.1 | 0.4-1.0 | 0.7-1.2 | 0.4-1.0 |
| N | 0.05-0.4 | 0.03-0.2 | 0.01-0.025 | 0.02-0.08 |

13. The alloy of any one of items 1 to 12, wherein an article cast from the alloy can be hardened by cryogenic hardening.
14. The alloy of item 13 wherein a Vickers hardness (HV) of an article cast from the alloy can be increased by at least 15% by a cryogenic hardening of the article.
15. The alloy of item 13 or item 14, wherein a Brinell hardness (HB) of an article sand-cast from the alloy can be increased by at least 10% by a cryogenic hardening of the article.

16. The alloy of any one of items 1 to 15, wherein the alloy has a carbide-boride-nitride volume fraction (CBNVF) of from higher than 35 (e.g., not less than 36, 37, 38, 39 or 40) to lower than 50 (e.g., not more than 49, 48, 47, 46 or 45), calculated according to the following equation:

$$CBNVF=C_E\times12.33+(\%\ Cr+\%\ M)\times0.55-15.2$$

with M=total percentage of V, Mo, Nb, and Ti, and $$C_E=\%\ C+\%\ N+(f\times\%\ B),\ \text{where}$$

f=1.8 for B concentrations from 0.1% to 0.49%
2.6 for B concentrations from 0.5% to 0.99%
3.2 for B concentrations from 1.0% to 1.4%.

17. An article cast from the alloy of any one of items 1 to 16.
18. The article of item 17, wherein a Brinell hardness (HB) of the sand-cast article is at least 600.
19. The article of item 17 or item 18, wherein the sand-cast article has been hardened by cryogenic hardening.
20. The article of any one of items 17 to 19, wherein the article has been cryogenically hardened.
21. The article of item 20, wherein the metal matrix microhardness represented by the Vickers Hardness (HV) of the cryogenically hardened article is at least 15% higher than the article before the cryogenic hardening.
22. The article of item 20 or item 21, wherein the Brinell Hardness (HB) of the cryogenically hardened article is at least 10% higher than the article before the cryogenic hardening.
23. The article of any one of items 20 to 22, wherein HV and/or HB of the cryogenically hardened article is at least as high as HV and/or HB of an article hardened at temperatures of from 1000° C. to 1100° C.
24. A method of hardening an article cast from the alloy of any one of items 1 to 16, wherein the method comprises subjecting the article to cryogenic hardening.
25. The method of item 24, wherein the cryogenic hardening comprises cooling the article at a cooling rate of from about 20° C. to about 40° C. per hour until a temperature of the article has reached from about −75° C. to about −90° C. and keeping the article at that temperature for about 15 minutes to about 35 minutes for every cm of thickness of the article.
26. The method of item 25, wherein cooling the article comprises contacting it with liquid nitrogen or liquid air.
27. A method of producing an article from an alloy of any one of items 1 to 16, wherein the method comprises pouring the molten alloy into a sand mold or a copper mold, allowing the alloy to cool to about ambient temperature and subjecting the resultant article to cryogenic hardening.
28. The method of item 27, wherein the cryogenic hardening comprises cooling the article at a cooling rate of from about 20° C. to about 40° C. per hour until a temperature of the article has reached from about −75° C. to about −90° C. and keeping the article at that temperature for about 15 minutes to about 35 minutes for every cm of thickness of the article.

EXAMPLES

In the following examples the procedures used for determining the Vickers Hardness (HV) and the Brinell Hardness (HB) were as follows:

Vickers Hardness (HV)

The Vickers Hardness was determined by the method set forth in ASTM E384. In this method, a pyramid shaped diamond indenter is applied smoothly into the surface of the material. The indenter is held in place for 10 to 15 seconds and then fully retreated. Using a microscope, the diagonals of resulting indentation are measured, and the hardness value is calculated by dividing the load by the surface area of the indentation.

A LECO LM 700AT microhardness tester with ConfiDent software was used. Samples for the microindentation hardness test were cut out of the bulk sample using a bench-top abrasive saw. Small pieces were then mounted in a thermoset phenolic compound using a Buehler SimpliMet 3000 mounting press. Mounted samples were then ground flat and polished with the help of an EcoMet 300 Pro grinder-polisher. Right before hardness testing, the surface of the sample was chemically etched to aid in distinguishing between different metallic phases of the material.

The final hardness number was based on the average of 8-20 different indentations. The number of times each sample has to be tested is usually based on the thermal treatment of the sample. As cast samples tend to require larger number of indentations because their hardness values tend to vary greatly. Heat and cryogenically treated samples are usually more consistent in their micro hardness.

Brinell Hardness (HB) vs. Micro-Indentation Vickers Hardness (HV)

The Brinell hardness is used to measure the bulk hardness of a material. The test consists of pressing a 10 mm tungsten carbide ball against the surface of the metal with a 300 kg force. In white irons this results in round indentation with diameter usually between 2.1 mm to 3.4 mm. The lower the diameter is, the higher the hardness value. Because of the relatively large size of the indentation this is considered bulk hardness (carbides and metal matrix hardness together).

The micro-indentation Vickers hardness values reported below were usually obtained by using a load of less than 1 kg, namely 25 g. With the lower hardness the indentation is small enough to test different phases separately. All the Vickers hardness test results refer to the Metal Matrix Hardness.

The carbide hardness is not affected by the hardening method (heat or cryogenic treatment). The change is in the metal matrix hardness. Therefore, the micro-indentation hardness HV allows a more accurate assessment of the effect of the cryogenic/freezing vs thermal treatment of the sample.

Preparation of Samples

The molten alloys were poured at a temperature of 2550° F.±10° F. into sand molds with dimensions of 20 mm×20 mm×110 mm to obtain samples for testing of each alloy. For chill casting each alloy was poured into a copper mold (30 mm diameter×35 mm height). The castings were cooled to ambient temperature both in the sand molds and the chill molds.

Cryogenic Treatment of Cast Samples

The procedure involved placing the casting in an enclosed and insulated box and then spraying liquid nitrogen over its entire area. The cooling rate was 50° F. per hour. Once the casting temperature reached −150° F. it was held at that temperature for 1 hour per every inch of its thickness.

The concentration numbers in the following tables are in percent by weight.

Example 1

| Alloy | C | Si | Mn | P | S | Cr | Mo | Ni | Cu | Nb | B | N | Fe |
|---|---|---|---|---|---|---|---|---|---|---|---|---|---|
| 1 | 2.66 | 0.55 | 0.61 | 0.018 | 0.031 | 16.43 | 2.07 | 0.58 | 0.26 | 1.08 | 0.46 | 0.03 | 75.1 |
| 2 | 2.37 | 0.51 | 0.56 | 0.019 | 0.030 | 16.37 | 2.05 | 0.53 | 0.25 | 1.19 | 0.65 | 0.03 | 75.4 |
| 3 | 2.15 | 0.48 | 0.54 | 0.02 | 0.028 | 16.33 | 2.05 | 0.49 | 0.25 | 1.18 | 0.85 | 0.03 | 75.5 |

Vickers Hardness (HV)

| Alloy | As Cast | Frozen | Heat Treated |
|---|---|---|---|
| 1 | 435 | 635 | 802 |
| 2 | 432 | 647 | 804 |
| 3 | 455 | 680 | 811 |

Brinell Hardness (HB)—Sand Cast

| Alloy | As Cast | Frozen | Heat Treated | Tempered (500° F. and 800° F.) | Tempered (1000° F.) |
|---|---|---|---|---|---|
| 1 | 578 | 712 | 712! | 745! | 682 |
| 2 | 601 | 712 | 712! | 712! | 697! |
| 3 | 653 | 780 | 745! | 712! | 682! |

Brinell Hardness (HB)—Chill Cast

| Alloy | As Cast | Frozen | Heat Treated | Tempered (500° F. and 800° F.) | Tempered (1000° F.) |
|---|---|---|---|---|---|
| 1 | 682 | 780 | 817! | 817! | 712! |
| 2 | 682 | 817 | 856! | 817! | 712! |
| 3 | 712 | 899 | 817! | 817! | 712! |

"!" indicates some observed cracks on the sample surface caused by indentation

From the results shown above it can be seen that the samples that were heat treated are on average 151 Vickers units harder than the cryogenically treated samples, which is believed to be due to the formation of secondary carbides during the heat treatment, making the metal matrix brittle. The formation of secondary carbides depletes carbon from the matrix, thereby making the remaining martensite softer. Furthermore, a heat treatment does not completely transform the matrix, increasing the percentage of retained austenite. Retained austenite makes the casting more prone to spalling. Spalling occurs when high velocity particles impact the surface of the casting, transforming the impacted area of austenite to martensite. This transformation causes the affected area to break off the casting because of the difference in volume between austenite and martensite. A cryogenic hardening treatment vastly reduces the percentage of retained austenite. With a lower percentage of retained austenite the resistance of the casting to spalling increases greatly.

The above Alloy 3 was divided into two samples. Sample 1 was hardened by conventional high temperature heat treatment where the sample is heated to above the austenitizing temperature and held at this temperature. During austenitizing, precipitation of secondary carbides occurs through diffusion as shown in FIG. 1. This results in a lower carbon matrix and destabilization of austenite. The alloy was then air quenched and the destabilization of the mostly austenitic matrix resulted in a higher martensite transformation temperature and a higher percentage of austenite which is available for transformation during the quenching. However, the carbon content in the transformed martensite is moderate, therefore the hardness of the martensite is moderate as well.

Sample 2 was hardened by freezing. This is a diffusionless transformation which occurs over a temperature range of 300° F., for example from 300° F. to −300° F. The starting temperature of the transformation varies depending on the stability of the austenite, which varies based on the composition of the alloy. Based on FIG. 2 and in view of the microhardness readings of Sample 1 and Sample 2 being within the same range with the reading of Sample 2 slightly higher than the reading of Sample 1, it can be concluded that the boron augmentation destabilizes the austenite to achieve almost full transformation from austenite to martensite over the freezing temperature range. Because carbon was not precipitated out of the matrix in the freezing treatment, the martensite in Sample 2 is more saturated in carbon than Sample 1, which results in a higher martensite hardness.

When the Brinell hardness of both samples was tested, Sample 1 exhibited microcracks, whereas Sample 2 did not. This is indicative of a lower fracture toughness of Sample 1 than that of Sample 2. The secondary carbides precipitated during the high temperature heat treatment have an embrittling effect on the alloy, whereas the saturated martensite is similar, or higher in hardness, but more ductile.

Regarding FIG. 1 (Sample 1), the fine white grains which can be seen throughout the matrix are secondary carbides precipitated during heat treatment.

Figure 2:
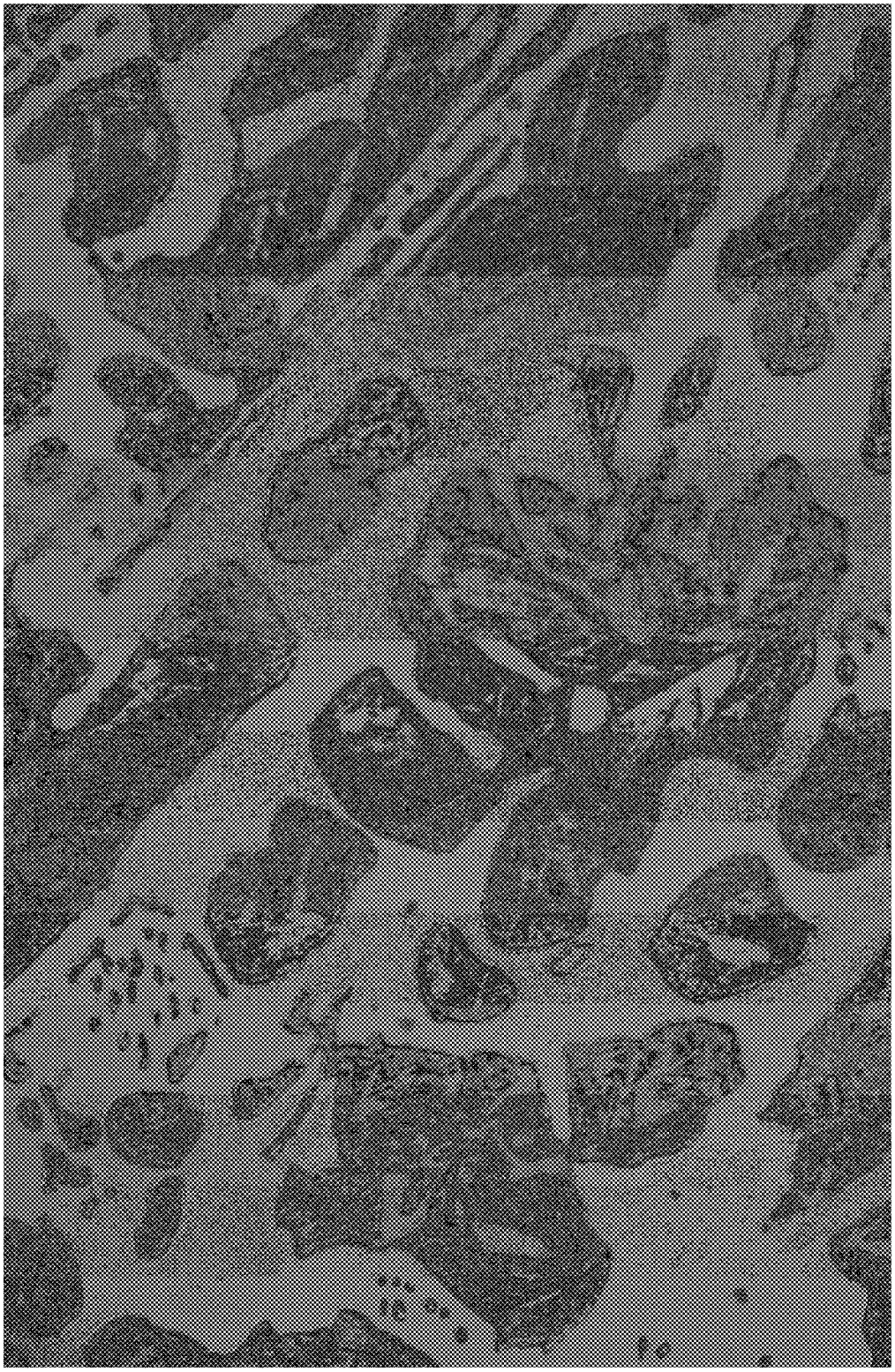
FIG. 2 is a photograph which shows the microstructure of a sample made from Alloy 3 after cryogenic hardening.

Regarding FIG. 2 (Sample 2), the needle like structure which can be seen throughout the matrix is martensite transformed from austenite during freezing.

Example 2

| Alloy | C | Si | Mn | P | S | Cr | Mo | Ni | Cu | V | B | N | Fe |
|---|---|---|---|---|---|---|---|---|---|---|---|---|---|
| 4 | 2.63 | 0.45 | 0.64 | 0.016 | 0.019 | 16.79 | 2.09 | 0.71 | 0.72 | 0.91 | 0.56 | 0.03 | 74.4 |
| 5 | 2.39 | 0.45 | 0.61 | 0.016 | 0.019 | 16.68 | 2.08 | 0.69 | 0.72 | 0.89 | 0.75 | 0.03 | 74.6 |
| 6 | 2.18 | 0.45 | 0.60 | 0.017 | 0.019 | 16.64 | 2.08 | 0.70 | 0.74 | 0.87 | 0.94 | 0.03 | 74.7 |

Vickers Hardness

| Alloy | As Cast | Frozen | Heat Treated | Heat Treated then Frozen |
|---|---|---|---|---|
| 4 | 432 | 698 | 707 | — |
| 5 | 450 | 719 | 689 | 714 |
| 6 | 593 | 735 | 677 | 709 |

Brinell Hardness (HB)—Sand Cast

| Alloy | As Cast | Heat Treated |
|---|---|---|
| 4 | 614 | 728 |
| 5 | 653 | 745 |
| 6 | 682 | 745 |

Brinell Hardness (HB)—Chill Cast

| Alloy | As Cast | Heat Treated |
|---|---|---|
| 4 | 712 | 836 ! |
| 5 | 745 | 856 ! |
| 6 | 745 ! | 836 ! |

"!" indicates some observed cracks on the sample surface caused by indentation

As can be taken from the above results, the Vickers hardness of the frozen samples of Alloys 5 and 6 is higher than the Vickers hardness of the samples of the corresponding heat treated alloys. This is believed to be due to the fact that the heat treated samples contained undesirable amounts of retained austenite. When the heat treated samples were frozen, the Vickers hardness thereof decreased compared to that of the samples which were only frozen, which is believed to be due to a transformation of at least some of the retained austenite to martensite.

Example 3

| | C | Si | Mn | P | S | Cr | Mo | Ni | Cu | V | B | Nb | N | Fe |
|---|---|---|---|---|---|---|---|---|---|---|---|---|---|---|
| 7 | 2.52 | 2.22 | 0.65 | 0.017 | 0.017 | 8.65 | 0.56 | 4.11 | 0.53 | 1.22 | 0.82 | 0.76 | 0.02 | 78.3 |
| 8 | 2.38 | 2.24 | 0.66 | 0.018 | 0.017 | 8.66 | 0.54 | 4.11 | 0.53 | 1.24 | 0.93 | 0.78 | 0.02 | 78.4 |
| 9 | 2.16 | 2.29 | 0.68 | 0.018 | 0.017 | 8.65 | 0.54 | 4.12 | 0.54 | 1.23 | 1.04 | 0.81 | 0.02 | 78.5 |

Vickers Hardness (HV)

| Alloy | As Cast | Frozen |
|---|---|---|
| 7 | 386 | 692 |
| 8 | 407 | 695 |
| 9 | 399 | 698 |

Brinell Hardness (HB)—Sand Cast

| Alloy | As Cast | Frozen |
|---|---|---|
| 7 | 653 | 780 |
| 8 | 653 | 780 |
| 9 | 653 | 745 |

Brinell Hardness (HB)—Chill Cast

| Alloy | As Cast | Frozen |
|---|---|---|
| 7 | 745 | 780 |
| 8 | 745 | 780 |
| 9 | 682 | 780 |

"!" indicates some observed cracks on the sample surface caused by indentation

Example 4

| Alloy | C | Si | Mn | P | S | Cr | Mo | Ni | Cu | V | B | Nb | N | Fe |
|---|---|---|---|---|---|---|---|---|---|---|---|---|---|---|
| 10 | 2.38 | 2.37 | 0.70 | 0.015 | 0.015 | 8.79 | 0.51 | 4.15 | 0.60 | 1.33 | 0.97 | 0.78 | 0.02 | 78.1 |
| 11 | 2.36 | 2.31 | 0.67 | 0.016 | 0.014 | 9.95 | 0.51 | 4.18 | 0.59 | 1.31 | 0.94 | 0.76 | 0.02 | 77.1 |
| 12 | 2.35 | 2.28 | 0.66 | 0.015 | 0.014 | 11.16 | 0.49 | 4.09 | 0.58 | 1.29 | 0.93 | 0.76 | 0.02 | 76.1 |

Vickers Hardness (HV)

| | As Cast | Frozen |
|---|---|---|
| 10 | 460 | 732 |
| 11 | 487 | 686 |
| 12 | 425 | 701 |

Brinell Hardness (HB)—Sand Cast

| | As Cast | Frozen |
|---|---|---|
| 10 | 653 | 745 |
| 11 | 653 | 745 |
| 12 | 627 | 745 |

Brinell Hardness (HB)—Chill Cast

| | As Cast | Frozen |
|---|---|---|
| 10 | 712 | 817 |
| 11 | 712 | 817 |
| 12 | 745 | 817 |

Example 5

| Alloy | C | Si | Mn | P | S | Cr | Mo | Ni | Cu | W | B | Nb | N | Fe |
|---|---|---|---|---|---|---|---|---|---|---|---|---|---|---|
| 13 | 2.32 | 2.54 | 0.69 | 0.017 | 0.019 | 8.58 | 0.51 | 4.11 | 0.59 | 1.11 | 0.95 | 0.75 | 0.02 | 77.6 |
| 14 | 2.21 | 2.43 | 0.67 | 0.017 | 0.020 | 8.48 | 0.49 | 4.06 | 0.58 | 2.42 | 0.95 | 0.73 | 0.02 | 76.7 |

Vickers Hardness (HV)

| Alloy | As Cast | Frozen |
|---|---|---|
| 13 | 405 | 708 |
| 14 | 423 | 722 |

Brinell Hardness (HB)—Sand Cast

| Alloy | As Cast | Frozen |
|---|---|---|
| 13 | 653 | 780 |
| 14 | 653 | 780 |

Brinell Hardness (HB)—Chill Cast

| Alloy | As Cast | Frozen |
|---|---|---|
| 13 | 745 | 817 |
| 14 | 682 | 780 |

Example 6

| Alloy | C | Si | Mn | P | S | Cr | Mo | Ni | Cu | B | Nb | N | Fe |
|---|---|---|---|---|---|---|---|---|---|---|---|---|---|
| 15 | 2.47 | 0.65 | 1.29 | 0.019 | 0.039 | 27.02 | 0.61 | 0.42 | 0.63 | 0.55 | 1.36 | 0.31 | 64.8 |
| 16 | 2.27 | 0.62 | 1.20 | 0.021 | 0.035 | 27.06 | 0.55 | 0.41 | 0.59 | 0.66 | 1.41 | 0.30 | 65.2 |
| 17 | 2.18 | 0.59 | 1.11 | 0.021 | 0.035 | 27.03 | 0.53 | 0.39 | 0.58 | 0.70 | 1.46 | 0.31 | 65.3 |

Vickers Hardness (HV)

| | As Cast | Frozen |
|---|---|---|
| 15 | 573 | 680 |
| 16 | 531 | 684 |
| 17 | 544 | 691 |

Brinell Hardness (HB)—Sand Cast

| | As Cast | Frozen |
|---|---|---|
| 15 | 578 | 682 |
| 16 | 601 | 712 |
| 17 | 627 | 712! |

Brinell Hardness (HB)—Chill Cast

| | As Cast | Frozen |
|---|---|---|
| 15 | 745 | 780 |
| 16 | 745 | 780 |
| 17 | 712 | 780! |

"!" indicates some observed cracks on the sample surface caused by indentation

Example 7 (Comparative)

| Alloy | C | Si | Mn | P | S | Cr | Mo | Ni | Cu | B | Fe |
|---|---|---|---|---|---|---|---|---|---|---|---|
| 18 | 1.97 | 0.48 | 0.77 | 0.013 | 0.028 | 25.34 | 0.02 | 0.91 | 0.14 | 0.01 | 70.1 |
| 19 | 1.95 | 0.51 | 0.78 | 0.015 | 0.029 | 25.38 | 0.02 | 0.91 | 0.15 | 0.56 | 69.4 |
| 20 | 1.81 | 0.49 | 0.72 | 0.015 | 0.029 | 25.32 | 0.02 | 0.98 | 0.15 | 0.63 | 69.6 |
| 21 | 1.72 | 0.47 | 0.66 | 0.016 | 0.031 | 25.36 | 0.02 | 1.08 | 0.15 | 0.73 | 69.5 |

Vickers Hardness (HV)

| Alloy | As Cast | Heat treated | Frozen |
|---|---|---|---|
| 18 | 468 | 738 | 392 |
| 19 | 524 | 740 | 535 |
| 20 | 496 | 756 | 496 |
| 21 | 485 | 749 | 529 |

Brinell Hardness (HB)—Sand Cast

| Alloy | As Cast | Frozen |
|---|---|---|
| 18 | 429 | 444 |
| 19 | 555 | 653 |
| 20 | 566 | 653 |
| 21 | 601 | 653 |

Brinell Hardness (HB)—Chill Cast

| Alloy | As Cast | Frozen |
|---|---|---|
| 18 | 437 | 514 |
| 19 | 627 | 653 |
| 20 | 627 | 653 |
| 21 | 627 | 682 |

As can be taken from the above results, the absence of nitrogen in Alloys 18-21 causes the cryogenic hardening of the cast alloys to be almost ineffective.

Example 8

| Alloy | C | Si | Mn | P | S | Cr | Mo | Ni | Cu | V | B | Ce | La | Nb | Mg | N | Fe |
|---|---|---|---|---|---|---|---|---|---|---|---|---|---|---|---|---|---|
| 22 | 2.72 | 2.17 | 0.59 | 0.017 | 0.01 | 8.61 | 0.58 | 4.17 | 0.44 | 1.28 | 1.12 | 0.31 | 0.12 | 0.71 | 0.019 | 0.02 | 77.6 |
| 23 | 2.72 | 2.13 | 0.59 | 0.016 | 0.01 | 8.61 | 0.58 | 4.18 | 0.44 | 1.28 | 1.12 | 0.61 | 0.25 | 0.71 | 0.018 | 0.02 | 77.3 |

Vickers Hardness (HV)

| | As Cast | Frozen |
|---|---|---|
| 22 | 582 | 714 |
| 23 | 560 | 709 |

Brinell Hardness (HB)—Sand Cast

| | As Cast | Frozen |
|---|---|---|
| 22 | 712 | 798 |
| 23 | 712 | 798 |

Brinell Hardness (HB)—Chill Cast

| | As Cast | Frozen |
|---|---|---|
| 22 | 817 | 856 |
| 23 | 817 | 856 ! |

"!" indicates some observed cracks on the sample surface caused by indentation

Example 9 (Comparative)

| Alloy | C | Si | Mn | P | S | Cr | Mo | Ni | Cu | V | B | Ce | La | Nb | Ti | N | Fe |
|---|---|---|---|---|---|---|---|---|---|---|---|---|---|---|---|---|---|
| 24 | 2.89 | 2.31 | 0.72 | 0.023 | 0.019 | 8.46 | 0.37 | 4.19 | 0.46 | 1.19 | 1.17 | 0.31 | 0.14 | 0.66 | 0.07 | 0.02 | 77.9 |
| 25 | 2.88 | 2.28 | 0.72 | 0.023 | 0.019 | 8.49 | 0.37 | 4.18 | 0.46 | 1.19 | 1.17 | 0.33 | 0.15 | 0.65 | 0.07 | 0.02 | 77.9 |
| 26 | 2.88 | 2.23 | 0.71 | 0.023 | 0.016 | 8.47 | 0.36 | 4.18 | 0.46 | 1.18 | 1.15 | 0.43 | 0.19 | 0.65 | 0.07 | 0.02 | 77.9 |

Vickers Hardness (HV)

| | As Cast | Frozen |
|---|---|---|
| 24 | 534 | 610 |
| 25 | 528 | 706 |
| 26 | 518 | 707 |

Brinell Hardness (HB)—Sand Cast

| | As Cast | Frozen |
|---|---|---|
| 24 | 780 | 817 |
| 25 | 745 | 817 |
| 26 | 745 | 817 |

Brinell Hardness (HB)—Chill Cast

| | As Cast | Frozen |
|---|---|---|
| 24 | 780 | 856 ! |
| 25 | 780 | 856 ! |
| 26 | 780 | 817 ! |

"!" indicates some observed cracks on the sample surface caused by indentation

Example 10

| Alloy | C | Si | Mn | P | S | Cr | Mo | Ni | Cu | B | Nb | N | V | Fe |
|---|---|---|---|---|---|---|---|---|---|---|---|---|---|---|
| 9 | 2.16 | 2.29 | 0.68 | 0.02 | 0.02 | 8.65 | 0.54 | 4.12 | 0.54 | 1.04 | 0.81 | 0.02 | 1.23 | 78.5 |
| 27 | 3.25 | 2.15 | 1.40 | 0.03 | 0.05 | 8.41 | 0.46 | 5.50 | 0.38 | 0.80 | 0.72 | 0.02 | 1.20 | 76.7 |

Vickers Hardness (HV)

| | As Cast | Frozen |
|---|---|---|
| 9 | 405 | 708 |
| 27 | 380 | 430 |

Brinell Hardness (HB)—Sand Cast

| | As Cast | Frozen |
|---|---|---|
| 9 | 653 | 780 |
| 27 | 712 | 745 |

As can be taken from the results set forth above, a concentration of carbon outside the claimed range in Alloy 27 results in a hardness of a cast article in the cryogenically hardened state is lower than that of an article cast from Alloy 9 in the cryogenically hardened state.

It is noted that the foregoing examples have been provided merely for the purpose of explanation and is in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A hypereutectic white iron alloy, wherein the alloy consists of, in weight percent based on a total weight of the alloy:

| | |
|---|---|
| C | from 1.5 to 2.85 |
| B | from 0.6 to 1.4 |
| N | from 0.01 to 1.2 |
| Cr | from 5 to 34 |
| Ni | from 0.2 to 7.5 |
| Si | from 0.1 to 4 |
| Mn | from 0 to 8 |
| Co | from 0 to 5 |
| Cu | from 0 to 5 |
| Mo | from 0 to 5 |
| W | from 0 to 6 |
| V | from 0 to 12 |
| Nb | from 0 to 6 |
| Ti | from 0 to 5 |
| Zr | from 0 to 2 |
| (Mg + Ca) | from 0 to 0.2 |

-continued

| | |
|---|---|
| one or more rare earth elements | from 0 to 3 |
| one or more of Ta, Hf, Al | from 0 to 3, |
| remainder Fe and incidental impurities, | |

and wherein a Brinell hardness (HB) of an article sand-cast from the alloy is at least 600.

2. The alloy of claim 1, wherein a concentration of C in the alloy is from 1.8% to 2.75%.

3. The alloy of claim 1, wherein a concentration of C in the alloy is from 1.9% to 2.72%.

4. The alloy of claim 1, wherein a concentration of C in the alloy is from 2.0% to 2.65%.

5. The alloy of claim 1, wherein a concentration of V in the alloy is from 0.8% to 4%.

6. The alloy of claim 1, wherein a concentration of B in the alloy is from 0.7% to 1.4%.

7. The alloy of claim 1, wherein a concentration of N in the alloy is from 0.02% to 0.5%.

8. The alloy of claim 1, wherein a concentration of Cr in the alloy is from 6% to 28%.

9. The alloy of claim 1, wherein a concentration of Ni in the alloy is from 0.3% to 5%.

10. The alloy of claim 1, wherein a concentration of Si in the alloy is from 0.3% to 3%.

11. The alloy of claim 1, wherein the alloy consists of:

| | |
|---|---|
| C | from 2.15 to 2.72 |
| B | from 0.7 to 1.4 |
| N | from 0.01 to 0.4 |
| Cr | from 8 to 28 |
| Ni | from 0.3 to 5 |
| Si | from 0.4 to 3 |
| Mn | from 0.5 to 1.4 |
| Co | from 0 to 5 |
| Cu | from 0 to 0.9 |
| Mo | from 0 to 3 |
| W | from 0 to 6 |
| V | from 0 to 2 |
| Nb | from 0 to 2 |
| Ti | from 0 to 5 |
| Zr | from 0 to 2 |
| (Mg + Ca) | from 0 to 0.2 |
| one or more rare earth elements | from 0 to 3 |
| one or more of Ta, Hf, Al | from 0 to 3, |
| remainder Fe and incidental impurities. | |

12. The alloy of claim 1, wherein the alloy has one of the following compositions 1 to 4:

| Composition | 1 | 2 | 3 | 4 |
|---|---|---|---|---|
| C | 2.2-2.7 | 1.6-2.0 | 1.9-2.6 | 2.0-2.7 |
| Si | 0.5-0.7 | 0.4-0.6 | 2.0-2.3 | 0.4-1.0 |
| Mn | 0.6-1.3 | 0.6-1.0 | 0.5-1.2 | 0.5-1.0 |
| Cr | 26.0-27.0 | 25-26 | 8-9 | 16-17 |
| Mo | 0.5-1.0 | 0.0-1.0 | 0.0-0.6 | 2.0-2.8 |
| Ni | 0.3-0.5 | 0.5-1.3 | 4-4.5 | 0.5-0.8 |
| Cu | 0.5-0.7 | 0.0-0.3 | 0.2-0.6 | 0.2-0.8 |
| V | 0.0-1.4 | 0.0-1.0 | 1.0-1.5 | 0.0-1.2 |
| Nb | 0.0-1.4 | 0.0-1.0 | 0.8-1.0 | 0.0-1.2 |

-continued

| Composition | 1 | 2 | 3 | 4 |
|---|---|---|---|---|
| B | 0.6-1.1 | 0.6-1.0 | 0.7-1.2 | 0.6-1.0 |
| N | 0.05-0.4 | 0.03-0.2 | 0.01-0.025 | 0.02-0.08. |

13. The alloy of claim 1, wherein the alloy has a carbide-boride-nitride volume fraction (CBNVF) of from higher than 35 to lower than 50, calculated according to the following equation:

$$CBNVF=C_E\times 12.33+(\%\ Cr+\%\ M)\times 0.55-15.2$$

with M=total percentage of V, Mo, Nb, and Ti, and $$C_E=\%\ C+\%\ N+(f\times\%\ B),\ \text{where}$$

f=2.6 for B concentrations from 0.6% to 0.99%

3.2 for B concentrations from 1.0% to 1.4%.

14. The alloy of claim 1, wherein a Vickers hardness (HV) of an article cast from the alloy can be increased by at least 15% by a cryogenic hardening of the article.

15. The alloy of claim 1, wherein a Brinell hardness (HB) of an article sand-cast from the alloy can be increased by at least 10% by a cryogenic hardening of the article.

16. An article cast from the alloy of claim 1.

17. The article of claim 16, wherein the article has been sand-cast, followed by cryogenic hardening.

18. A method of hardening an article cast from the alloy of claim 1, wherein the method comprises subjecting the article to cryogenic hardening.

19. The method of claim 18, wherein the cryogenic hardening comprises cooling the article at a cooling rate of from about 20° C. to about 40° C. per hour until a temperature of the article has reached from about −75° C. to about −90° C. and keeping the article at that temperature for about 15 minutes to about 35 minutes for every cm of thickness of the article.

* * * * *